US008079534B2

(12) United States Patent
Fecht et al.

(10) Patent No.: US 8,079,534 B2
(45) Date of Patent: Dec. 20, 2011

(54) SPRAY NOZZLE

(75) Inventors: Albert Fecht, Riederich (DE); Juergen Frick, Weinstadt-Endersbach (DE); Boris Schmidt, Esslingen (DE)

(73) Assignee: Lechler GmbH, Metzingen (DE)

( * ) Notice: Subject to any disclaimer, the term of this patent is extended or adjusted under 35 U.S.C. 154(b) by 593 days.

(21) Appl. No.: 12/152,453

(22) Filed: May 14, 2008

(65) Prior Publication Data

US 2008/0290197 A1 Nov. 27, 2008

Related U.S. Application Data

(60) Provisional application No. 60/958,934, filed on Jul. 10, 2007.

(30) Foreign Application Priority Data

May 15, 2007 (DE) ..... 10 2007 024 245

(51) Int. Cl.
*B05B 1/00* (2006.01)

(52) U.S. Cl. ..... 239/599; 239/590.5; 239/597; 239/601; 239/602; 239/DIG. 19

(58) Field of Classification Search ..... 239/589, 239/590.5, 597–599, 601, 602, DIG. 19
See application file for complete search history.

(56) References Cited

U.S. PATENT DOCUMENTS

| | | | | |
|---|---|---|---|---|
| 2,130,173 A | | 9/1938 | Barnes | |
| 2,774,631 A | * | 12/1956 | Wahlin | 239/601 |
| 3,346,195 A | | 10/1967 | Groth | |
| 3,510,065 A | * | 5/1970 | Gigantino et al. | 239/601 |
| 3,647,147 A | | 3/1972 | Cook | |
| 4,346,849 A | | 8/1982 | Rood | |
| 4,706,889 A | | 11/1987 | Hofmann | |
| 4,736,892 A | | 4/1988 | Calder | |
| 4,848,672 A | * | 7/1989 | Matsumoto et al. | 239/590.5 |
| 5,833,148 A | | 11/1998 | Steinhilber et al. | |
| 5,878,966 A | | 3/1999 | Asakawa et al. | |

FOREIGN PATENT DOCUMENTS

| | | |
|---|---|---|
| DE | 1 571 183 A1 | 11/1970 |
| DE | 27 32 314 A1 | 1/1978 |
| DE | 32 04 955 A1 | 9/1983 |
| EP | 0 771 592 A | 5/1997 |
| EP | 0 792 692 A1 | 9/1997 |
| EP | 0 792 692 B1 | 9/1997 |

OTHER PUBLICATIONS

Examination Report of German Patent Office dated Oct. 29, 2007 (4 pages).

* cited by examiner

*Primary Examiner* — Steven J Ganey
(74) *Attorney, Agent, or Firm* — Flynn, Thiel, Boutell & Tanis, P.C.

(57) ABSTRACT

The invention relates to a spray nozzle, particularly a high pressure nozzle, for descaling steel products, having a mouthpiece, which is provided with a discharge opening and a discharge chamber, which tapers towards the discharge opening.

According to the invention the discharge opening spans a curved surface and a surface surrounding the discharge opening boundary at each point of said boundary strikes the discharge opening boundary at an angle between 65 and 95°, particularly 90° to the median longitudinal axis.

Use e.g. for descaling nozzles.

16 Claims, 5 Drawing Sheets

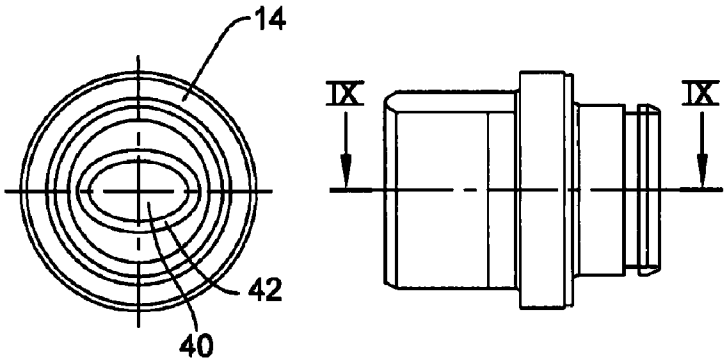
FIG. 7
FIG. 8
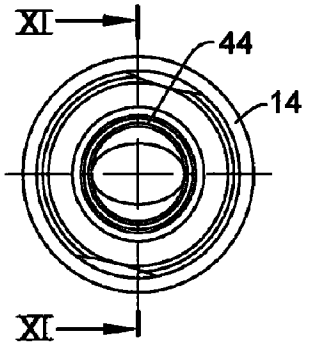
FIG. 10
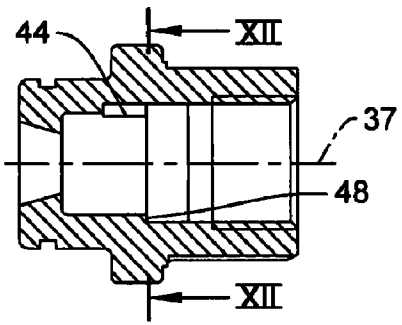
FIG. 11
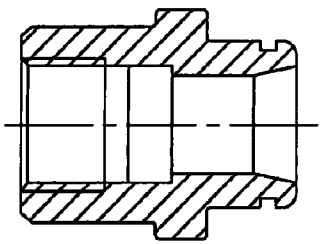
FIG. 9
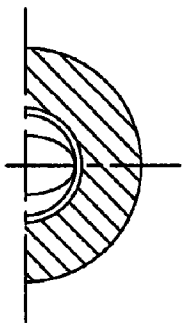
FIG. 12
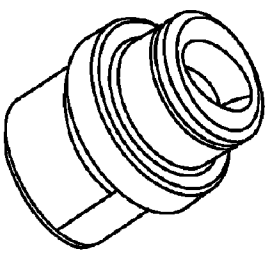
FIG. 13

SPRAY NOZZLE

CROSS REFERENCE TO RELATED APPLICATION

This application claims the benefit of U.S. Provisional Application No. 60/958,934, filed Jul. 10, 2007.

FIELD OF THE INVENTION

The invention relates to a spray nozzle, particularly a high pressure nozzle, for descaling steel products, having a mouthpiece, said mouth piece having a discharge opening and a discharge chamber tapering towards the discharge opening.

BACKGROUND OF THE INVENTION

Known high pressure nozzles for descaling steel products are constructed as flat-spray nozzles. The mouthpiece for such descaling nozzles conventionally has a discharge opening to which is connected a jet-forming discharge cone. European patent EP 792 692 B1 e.g. discloses a mouthpiece for a descaling nozzle, in which a discharge chamber tapering towards the discharge opening passes downstream of the latter into conically widening boundary surfaces of the mouthpiece. These boundary surfaces define the flat jet formed with respect to its lateral extension. The discharge opening and discharge cone can be elliptical.

SUMMARY OF THE INVENTION

The invention aims at providing an improved high pressure nozzle.

For this purpose, according to the invention is provided a high pressure nozzle, particularly for descaling steel products and having a mouthpiece, which has a discharge opening and a discharge chamber tapering towards said discharge opening, in which the discharge opening spans, considered from the discharge chamber, a curved surface, e.g. a convex or concave surface and in which the surface surrounding the boundary of the discharge opening at each point of said boundary of the discharge opening radially strikes the same at an angle between 65 and 95°, particularly 90° to the median longitudinal axis.

Thus, no discharge cone is connected to the mouthpiece discharge opening and instead the water-guiding portions of the nozzle terminate abruptly with the discharge opening. It has surprisingly been found that as a result of such a mouthpiece construction it is possible to attain a cleaner, sharply defined jet, even in the case of very high water pressures. Through the provision of a discharge opening spanning the curved surface, it is also possible to bring about an adequate ventilation of the emerging jet, so that a vacuum is not formed laterally of the jet so as to negatively influence the discharge jet or bring about an unsteady behaviour. An end face of the mouthpiece surrounding the discharge opening, at each point of the boundary, strikes at an angle between 85° and 95°, particularly 90° to the median longitudinal axis the discharge opening boundary, the advantages of the invention being usable down to an angle of approximately 65°. At the discharge opening boundary the water jet leaves the nozzle and downstream of the discharge opening there are no longer any water-guiding nozzle components in that on the discharge opening boundary the surrounding surface strikes the boundary at an angle of approximately 90° to the median longitudinal axis, so as to create a sharp separating edge for the emerging jet. It is simultaneously possible to obtain a very stable mouthpiece design able to withstand the highest pressures. As the angle in which the surrounding end face of the mouthpiece strikes the discharge opening boundary is at each boundary point approximately at right angles, around the entire circumference of the emerging jet essentially the same conditions are created at the separating edge. This also contributes to a very clean formation of the desired flat spray cone. On the side remote from the discharge opening, the surface surrounding said discharge opening boundary preferably ends in a circle concentrically surrounding the median longitudinal axis. As a result the irregularly shaped surface surrounding the discharge opening can be returned to a regular geometrical shape.

According to a further development of the invention the surface surrounding the boundary of the discharge opening has first portions, which are located in a first position or in a first area along the median longitudinal axis, and second portions which are located in a second position, the second position and second area being spaced from the first position or first area along the median longitudinal axis in the outflow direction.

This ensures a good ventilation and a clearly defined air flow in the direction of the liquid jet emerging from the discharge opening. This brings about a time-constant spray pattern, because during nozzle operation there are clearly defined flow conditions around the emerging jet in the ambient air flowing towards said jet. Air sucked in through the emerging jet can be supplied over the first portions, which are upstream of the second portions relative to the outflow direction.

In a further development of the invention the surface surrounding the boundary of the outlet opening is subdivided into four sectors, two facing sectors being located in the first area and two further, facing sectors in the second area.

As a result of these measures air sucked in through the emerging jet is symmetrically passed over the sectors located in the upstream, first area.

In a further development of the invention the discharge opening boundary is defined by a cutting of a cone, particularly a circular cone, with a curved ellipse.

Even if the inventive high pressure nozzle in principle makes use of so-called free form faces, where i.e. mathematically the shape of the discharge opening boundary and the surfaces connected onto the same are defined, the inventive advantages are also achieved on cutting regular geometrical shapes, namely e.g. as a circular cone with a curved ellipse.

In a further development of the invention the mouthpiece is made from hard metal. Particularly in the case of descaling nozzles the mouthpiece is exposed to high loads, particularly abrasive effects of the sprayed liquid. Through the use of hard metal mouthpieces/carbide mouthpieces the nozzle life can be significantly extended.

In a further development of the invention the mouthpiece is held in a nozzle housing, which has an oval passage opening surrounding the discharge opening when seen in the direction of the nozzle median longitudinal axis.

Such an oval passage opening contributes to a high strength nozzle housing construction. If the high pressure nozzle according to the invention is constructed as a flat spray nozzle, an oval passage opening in the nozzle housing is better adapted to the cross-sectional shape of the flat spray or jet than the conventionally used circular passage opening. Thus, stagewise, more material can be left on the nozzle housing than would be the case with a circular passage opening, which increases the stability of the nozzle housing. An important point is that the oval passage opening surrounding the discharge opening has no function with respect to the jet formation. The spray jet emerging from the discharge opening is not in contact with the nozzle housing. There are no longer any water-guiding high pressure nozzle components downstream of the discharge opening and jet formation exclusively takes place by means of the high pressure nozzle mouthpiece. A circumferential wall of the nozzle housing emanating from the passage opening and ending level with the discharge opening is for this purpose spaced from the discharge opening border level with said discharge opening and perpendicular to the median longitudinal axis. This ensures that a spray jet emerging from the discharge opening does not contact the circumferential wall. The mouthpiece held in the nozzle housing can be sealed against the latter by a circumferential soldered metal joint, which can be made by laser soldering.

In a further development of the invention the mouthpiece and/or nozzle housing are produced by metal powder die casting.

Specifically in connection with the mouthpiece in the area surrounding the discharge opening it is necessary to have a geometrically complicated shaping of the mouthpiece, which cannot or can only be made with significant effort and expenditure by mechanical working. Through metal powder die casting substantially random shapes can be produced and specifically the shaping of the inventive high pressure nozzle in the area surrounding the discharge opening can be brought about even in the case of series production. Also when producing the mouthpiece from hard metal/carbide or a hard metal alloy the latter can be produced by metal powder die casting. In the case of metal powder die casting initially metal powder is mixed with a thermoplastic binder. Said mixture is then brought into a mould by means of die casting. In a following method step the thermoplastic binder is chemically or thermally removed. What is left is an intermediate product formed from the metal powder structure. Said intermediate product is then sintered and consequently acquires a high material strength.

BRIEF DESCRIPTION OF THE DRAWINGS

Further features and advantages of the invention can be gathered from the claims and the following description of a preferred embodiment in conjunction with the drawings, wherein show:

FIG. 7 A view of a nozzle housing of the inventive high pressure nozzle from the front.

FIG. 8 The nozzle housing of FIG. 7 in side view.

FIG. 9 A sectional view of plane IX-IX of FIG. 8.

FIG. 10 A view of the nozzle housing of FIG. 7 from the rear.

FIG. 11 A sectional view on plane XI-XI of FIG. 10.

FIG. 12 A sectional view on plane XII-XII of FIG. 11.

FIG. 13 A perspective view of the nozzle housing of FIG. 7.

DETAILED DESCRIPTION

Figure 14:
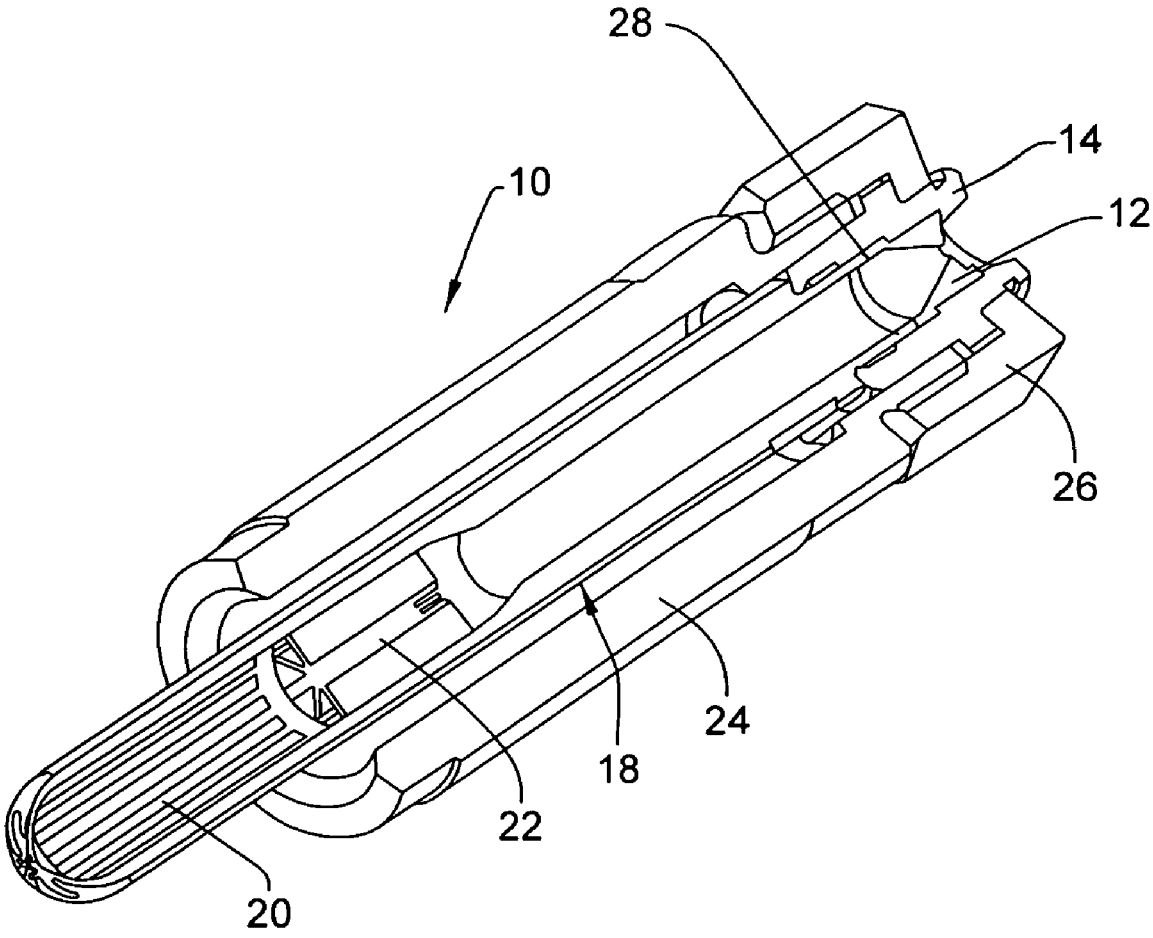
FIG. 14 A perspective, cut open view of an inventive high pressure nozzle.
Figure 15:
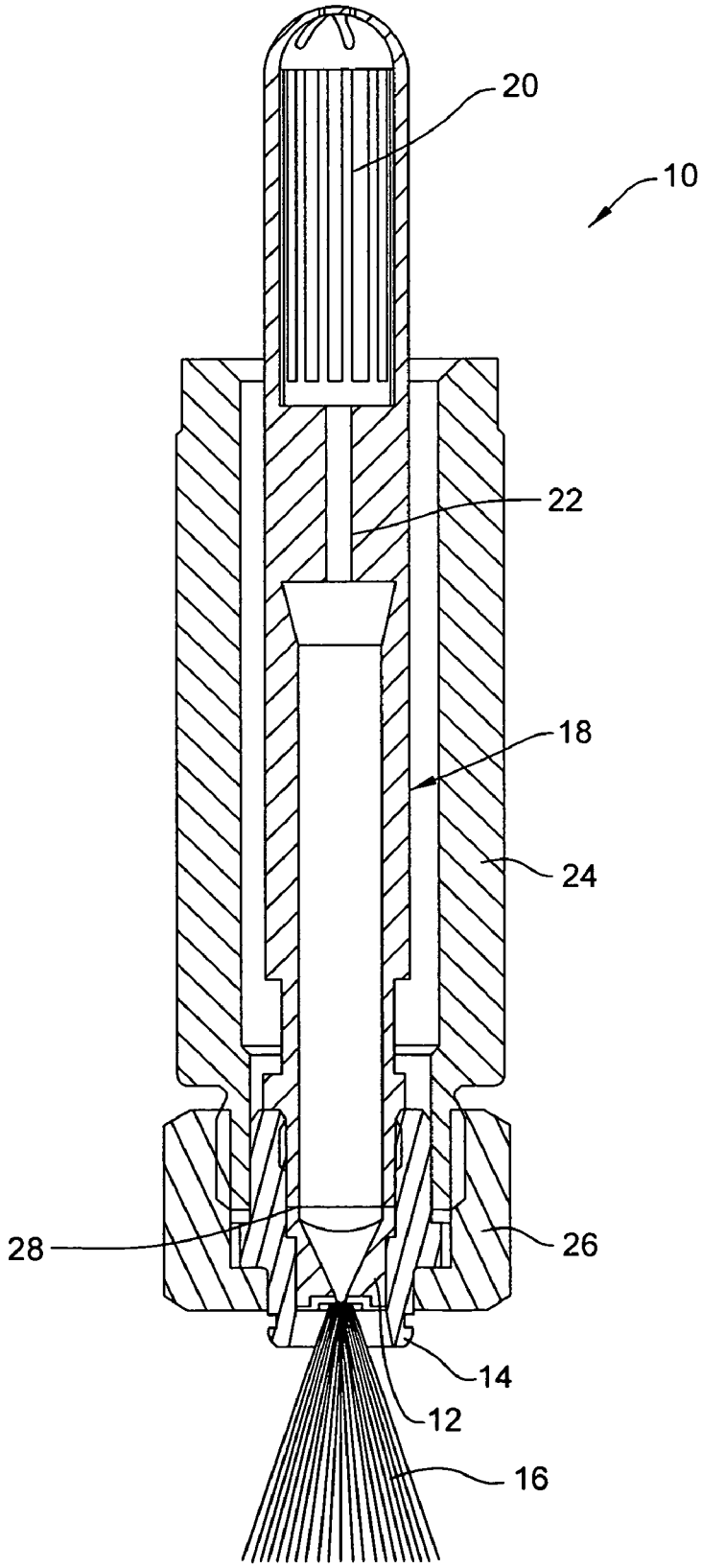
FIG. 15 A sectional view of the high pressure nozzle of FIG. 14.

The high pressure nozzle 10 according to the invention shown in FIGS. 14 and 15 has a mouthpiece 12 located in a nozzle housing 14. A flat spray or jet 16, which is solely diagrammatically shown in FIG. 15 passes out of mouthpiece 12. A combined filter and jet directing component 18 is connected to the nozzle housing 14 and positioned upstream of mouthpiece 12. The filter and jet directing component 18 provides a flow channel terminating at the entrance into mouthpiece 12. Liquid to be sprayed passes through a filter area 20 into the flow channel, is oriented by a jet director 22 and then passes to mouthpiece 12.

Nozzle housing 14 with mouthpiece 12 and the combined filter and jet directing component 18 is engaged in a liquid-guiding, tubular welding nipple 24 and is fixed to the end of said nipple 24 by means of a cap nut 26. The end of the tubular welding nipple facing mouthpiece 12 is connected to a not shown nozzle beam into which projects filter 20. Liquid to be sprayed is supplied via the upstream nozzle beam not shown in FIG. 15 to the tubular welding nipple 24 and also passes into an annular area between the filter and jet directing component 18 and an inner wall of the tubular welding nipple 24. As has already been discussed, the liquid passes through filter 20 into the filter and jet directing component 18 and ultimately passes back into the environment again from the discharge opening of mouthpiece 12.

The largest free flow cross-section occurs in the vicinity of filter 20 and is determined by the sum of the free cross-sections of the elongated filter slots and the further filter slots in the filter cap. There is an already significantly reduced flow cross-section in the vicinity of jet director 22, the free flow cross-section there resulting from the cross-section of the overall channel, less the end faces of the radially arranged flow guide surfaces. The ratio of the free flow cross-sectional surface at jet director 22 to the free flow cross-sectional surface of filter 20 is advantageously 1:6 or higher.

A further constriction of the flow cross-section occurs following jet director 22 on the cross-section of channel 27, which is guided with a constant cross-section to upstream of mouthpiece 12. The ratio of the free flow cross-sectional surface in channel 37 to the free flow cross-sectional surface at jet director 22 is advantageously 1:1.23 or higher.

The ratio of the free flow cross-sectional surface in channel 37 to the free flow cross-sectional surface of filter 20 is advantageously 1:7.44 or higher.

The free flow cross-sectional surface in channel 37 is e.g. 95 $mm^2$, the free flow cross-sectional surface in jet director 22 is e.g. 117 $mm^2$ and the free flow cross-sectional surface at filter 20 is e.g. 707 $mm^2$.

Between an inner wall of nozzle housing 14 and an annular end face of mouthpiece 12 at the upstream end of said mouthpiece 12 is provided a soldered metal joint 28 sealing mouthpiece 12 against nozzle housing 14.

Figure 1:
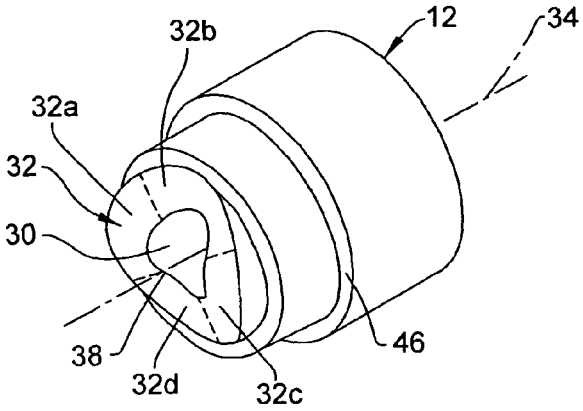
FIG. 1 A perspective view of a mouthpiece of an inventive high pressure nozzle sloping from the front.

The perspective view of mouthpiece 12 in FIG. 1 shows that a discharge opening of mouthpiece 12 spans a curved surface, specifically a curved ellipse. It can be seen that the boundary 38 of discharge opening 30 can span two differently curved surfaces, namely, considered in the outflow direction, an outwardly curved ellipse and once again, in the outflow direction, an inwardly curved ellipse.

The discharge opening 30 is surrounded by an end face 32 which, in FIG. 1, is subdivided by broken lines into four sectors 32*a*, 32*b*, 32*c* and 32*d*. In all the sectors 32*a*, 32*b*, 32*c* and 32*d* the surface 32 strikes perpendicular to a median longitudinal axis 34 on the boundary 38 of discharge opening 30. End face 32 has an undulatory shape and with respect to the median longitudinal axis and an outflow direction, which would run from right to left in FIG. 1, the two sectors 32*b* and 32*d* are located in a first, upstream area and the two sectors 32*a*, 32*c* in a second, downstream area. The two sectors 32*a*, 32*c* in the second area and the two facing sectors 32*b*, 32*d* in the first area are in each case constructed symmetrically to one another, so that overall there is a symmetrical shape of end face 32. Air sucked in by the emerging liquid jet is mainly supplied over the two sectors 32*b*, 32*d* located in the upstream, first area. Together with the symmetrical arrangement of these two upstream sectors 32*b*, 32*d* a time-stable discharge jet is obtained. Sectors 32*a*, 32*b*, 32*c* and 32*d* pass at their end remote from discharge opening 30 into an undulatory circumferential boundary edge to which is stagewise connected a cylindrical wall parallel to the outflow direction. The undulatory circumferential boundary edge is geometrically obtained in that at each point of the boundary 38 a line perpendicular to the median longitudinal axis 34 is led radially to the outside and is intersected by a circular cylinder. The connection of these intersection points on the surface of the circular cylinder then gives the undulatory circumferential boundary edge and the end face 32 is defined by the radially outwardly directed lines. The shape of the end face 32 according to FIG. 1 results from an upward bulging of a planar surface in the outwards direction. The shaping of end face 32 can e.g. be illustrated in that a circular piece of paper with an elliptical passage opening is provided. If said circular paper is now placed on a planar surface and in each case a finger is placed on the areas in which the longer semiaxis of the elliptical opening intersects the surrounding paper, the two fingers can then be moved towards one another and the ring formed by the paper will bulge upwards from the planar bearing surface with the exception of the portions on which the fingers are resting. As a result of such a procedure this roughly leads to the shape of end face 32 shown in FIG. 1.

Figure 2:
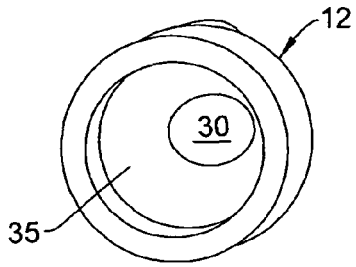
FIG. 2 A perspective view of the mouthpiece of FIG. 1 sloping from the rear.

FIG. 2 shows a discharge chamber 36 upstream of discharge opening 30. Discharge chamber 35 is shaped like a circular cone tapering in the outflow direction. Through the cutting of said circular cone with a curved ellipse the shape of the boundary 38 of discharge opening 30 is obtained.

Figure 3:
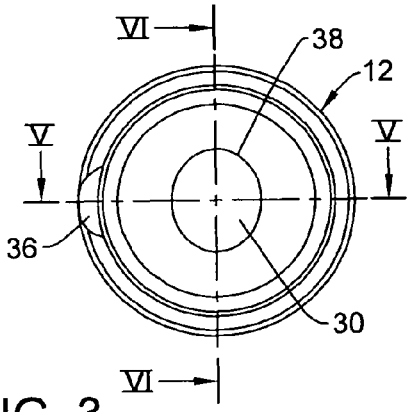
FIG. 3 A front view of the mouthpiece of FIG. 1.

In the front view of FIG. 3, i.e. counter to the outflow direction, the elliptical shape of discharge opening 30 is particularly apparent.

A nose 36 provided on the outer wall of mouthpiece 12 is provided for engaging in a matching recess in a nozzle housing and as a result on inserting the mouthpiece 12 in a nozzle housing a correct rotary position of the mouthpiece 12 is ensured.

Figure 4:
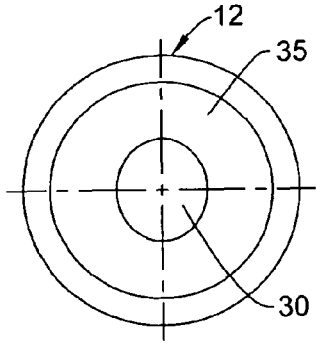
FIG. 4 A view of the mouthpiece of FIG. 1 from the rear.

The view from the rear of FIG. 4 also shows the elliptical shape of the discharge opening and also reveals the circular conical shape of discharge chamber 35.

Figure 5:
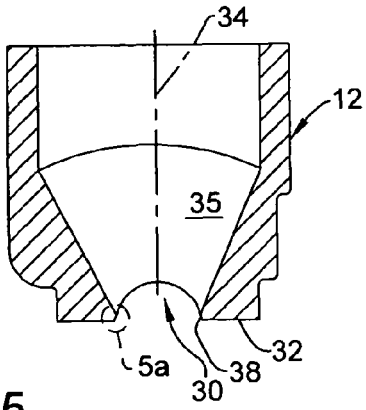
FIG. 5 A sectional view along plane V-V in FIG. 3.
Figure 6:
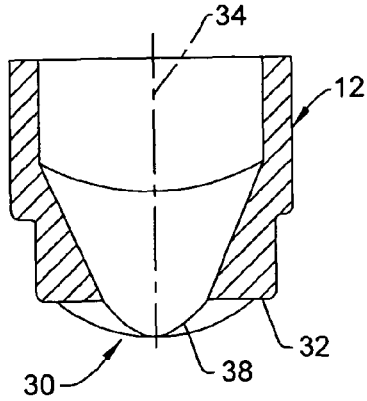
FIG. 6 A sectional view along plane VI-VI of FIG. 3.

The sectional view of FIG. 5 shows a section parallel to the shorter semiaxis of the elliptical discharge opening 30, as shown in FIG. 3. FIG. 5 clearly shows that the surface 32 surrounding discharge opening 30 strikes boundary 38 of discharge opening 30 at an angle of 90° to the median longitudinal axis 34. The sectional view of FIG. 5 reveals this for two facing points of boundary 38, whilst for two other facing points this can be gathered from the sectional view of FIG. 6, which is a view on a section plane parallel to the larger semiaxis of the elliptical discharge opening 30 shown in FIG. 3. Also in this sectional view the surface 32 surrounding discharge opening 30 runs towards discharge opening 30 perpendicular to median longitudinal axis 37 and strikes at an angle of 90° to median longitudinal axis 34 on the boundary 38 of discharge opening 30.

This applies to random section planes, because the surface 32 surrounding the boundary 38 of discharge opening 30 at each point of said boundary 38 strikes radially at an angle of 90° to the median longitudinal axis 34 on the boundary 38 of discharge opening 30. On leaving discharge opening 30 the emerging spray jet is consequently free and is no longer guided by nozzle guide surfaces. The water-guiding nozzle components consequently terminate at the separating edge, which results from the boundary 38 of discharge opening 30 and the surface 32 following onto boundary 38.

Figure 5A:
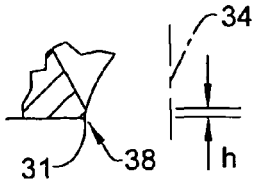
FIG. 5*a* A larger scale view of detail 5*a* in FIG. 5.

FIG. 5*a* shows detail 5*a* of FIG. 5 on a larger scale. It can be seen that the boundary 38 of discharge opening 30 is formed by means of a chamfer. The chamfer is inclined to the median longitudinal axis 34 in such a way that the angle formed by the median longitudinal axis and the chamfer opens in the outflow direction. The chamfer only has a very limited height h of e.g. 0.1 mm to max 0.2 mm. The chamfer is more particularly provided for production reasons, so that there is no highly sensitive, sharp edge when the mouthpiece 12 is made from hard metal. As explained relative to FIG. 1, surface 32 has two facing convex portions 32*a*, 32*c* and the two other facing concave portions 32*b*, 32*d*. When the spray jet passes out of the discharge opening 30 air is sucked in from the environment and can flow along concave portions 32*b*, 32*d* to discharge opening 30. Thus, clearly defined air flow conditions are formed in the area surrounding the emerging jet and consequently the vacuum produced by the emerging jet cannot lead to an unsteady jet formation.

In the vicinity of surface 32 mouthpiece 12 has a geometrically complicated shaping, which cannot be readily produced by mechanical working. Thus, mouthpiece 12 is produced by metal powder die casting, so that the concave/convex shaping in the vicinity of surface 32 can be obtained without difficulty. Therefore mouthpiece 12 is constructed as a sintered blank and produced by metal powder die casting from a starting material of hard metal powder and thermoplastic binder. After the removal of the binder and the following sintering a hard metal component is formed, which is able to withstand the high stresses during the operation of the inventive descaling nozzle.

FIGS. 7 to 13 show the nozzle housing 14 in which mouthpiece 12 is inserted. As can be seen in FIG. 7, nozzle housing 14 has an elliptical passage opening 40 which, when the nozzle is assembled, is located downstream of discharge opening 30. The passage opening 40 is bounded by a truncated cone-shaped wall widening in the outflow direction. It can be seen that the conically widening wall 42 is not used for liquid guidance purposes. On leaving discharge opening 30 the spray jet 36 continues its path as a free jet, as is also shown in FIG. 15. Thus, passage opening 40 merely serves to provide an air supply to discharge opening 30 and offer sufficient space for the passage of the spray jet 16.

The longer semiaxis of the elliptical passage opening 40 is oriented parallel to the longer semiaxis of the elliptical discharge opening 30. This creates sufficient space for the discharge of a flat jet from discharge opening 30 and simultaneously the nozzle housing 14 is weakened to the minimum possible extent. This is due to the fact that, compared with a circular passage opening, more material can be left on the nozzle housing 14 and consequently it only has to withstand lower material stresses. The nozzle housing 14 absorbs the shearing stresses and introduces the same into the tubular welding nipple 24, said stressing resulting from the liquid pressure in the flow direction on mouthpiece 12. As inventive high pressure descaling nozzles are operated at pressures of several 100 and up to 600 bar, considerable forces and stresses can occur.

FIGS. 10 and 11 show that the nozzle housing 14 has in the vicinity of its inner bore a recess 44, which matches projection 36 of mouthpiece 12. After inserting mouthpiece 12 in nozzle housing 14, said mouthpiece 12 is consequently precisely angularly oriented. As there is only one recess 44 and one projection 36, there is only one relative position of mouthpiece 12 and nozzle housing 14 in which said mouthpiece 12 can be inserted in said nozzle housing 14.

Following the complete insertion of mouthpiece 12 into nozzle housing 14, there is a circumferential, outwardly projecting step 46 of mouthpiece 12 on an inwardly projecting shoulder 48 of nozzle housing 14 and as a result is held in position parallel to the median longitudinal axis. Then, as has been explained, a soldered metal joint 28 is applied as a fillet joint between mouthpiece 12 and nozzle housing 14, so as to seal mouthpiece 12 against nozzle housing 14.

Figure 16:
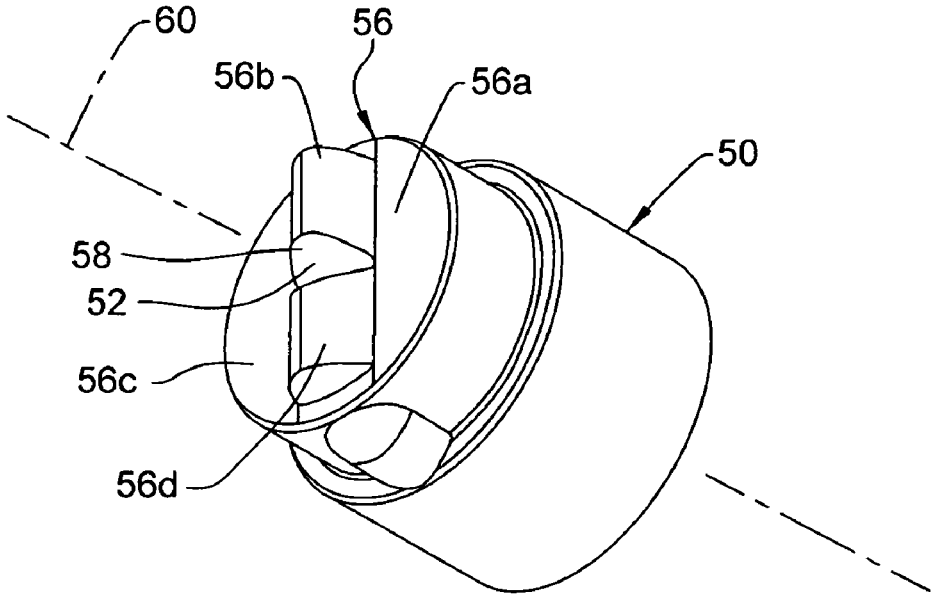
FIG. 16 A perspective representation of a mouthpiece of an inventive high pressure nozzle sloping from the front according to a second embodiment.
Figure 17:
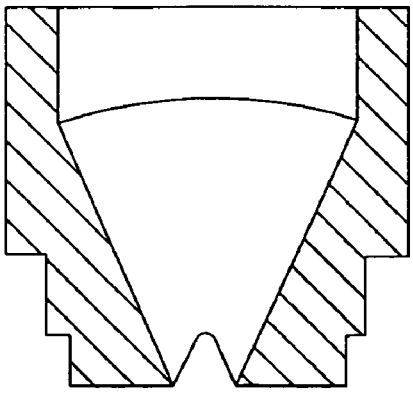
FIG. 17 A sectional view of the mouthpiece of FIG. 16.
Figure 18:
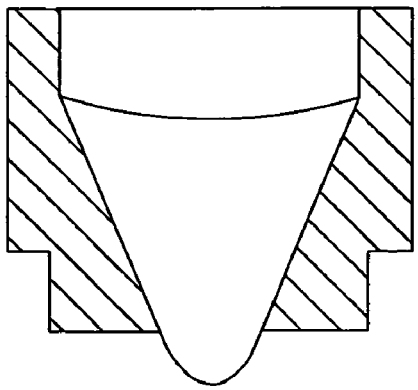
FIG. 18 A further sectional view of the mouthpiece of FIG. 16, the sectional plane being turned by 900 compared with FIG. 17.

FIG. 16 perspectively shows a mouthpiece 50 according to a second embodiment. With the exception of the shaping of a discharge opening 52 and the shaping of an end face 54 surrounding the discharge opening, mouthpiece 50 has an identical construction to mouthpiece 12 in FIG. 1. Thus, all that will be described hereinafter are the features differing from mouthpiece 12 of FIG. 1.

Discharge opening 52 is shaped like an ellipse curved outwards in the outflow direction. In all four portions 56*a*, 56*b*, 56*c* and 56*d* of end face 56 connect on to the discharge opening boundary 58. The two facing portions 56*a* and 56*c* are constructed as planar circular portions and the boundary 58 of discharge opening 52 in each case only touches portions 56*a*, 56*c* in one point located in the centre of the straight edge of the circular segmental areas 56*a*, 56*c*. The two facing portions 56*b*, 56*d* curve outwards in the outflow direction between the two portions 56*a*, 56*c*. Thus, portions 56*b*, 56*d* have roughly the shape of the circumferential surface of an elliptical semicylinder. The two portions 56*b*, 56*d* are positioned parallel to one another. Portions 56*a*, 56*b*, 56*c* and 56*d* of end face 56 consequently all run perpendicular to a median longitudinal axis 60 of mouthpiece 50. Thus, end face 56 over the entire circumference of a discharge jet strikes such a discharge jet perpendicular to the median longitudinal axis, so that a cleaner, sharply defined jet can be obtained, even in the case of very high water pressures. Nevertheless over portions 56*a*, 56*c* there is an adequate ventilation of the emerging jet, so that no vacuum which could lead to an unstable behaviour can form laterally of the emerging jet.

The invention claimed is:

1. Spray nozzle for descaling steel products, having a mouthpiece, with the mouthpiece including a discharge opening and a discharge chamber tapering towards said discharge opening, wherein the discharge opening spans a curved surface and a surface surrounding a boundary of the discharge opening contacts each point of said boundary at an angle between 65° and 95° to a median longitudinal axis on the boundary of the discharge opening, wherein the surface surrounding the boundary of the discharge opening has first portions located in a first area along the median longitudinal axis, and second portions located in a second area spaced from the first area in an outflow direction along the median longitudinal axis.

2. Spray nozzle according to claim 1, wherein the surface surrounding the boundary of the discharge opening contacts the boundary of the discharge opening at each point of said boundary radially at an angle between 65° and 95° to the median longitudinal axis.

3. Spray nozzle according to claim 1, wherein at least stagewise, the boundary of the discharge opening is formed by a chamfer.

4. Spray nozzle according to claim 2, wherein the surface surrounding the boundary of the discharge opening contacts each point of said boundary radially at an angle of 90° to the median longitudinal axis of the discharge opening.

5. Spray nozzle according to claim 1, wherein the surface surrounding the boundary of the discharge opening is subdivided into four portions including two further facing first portions located in the first area, and two further facing second portions located in the second area.

6. Spray nozzle according to claim 1, wherein the boundary of the discharge opening is defined by cutting a cone defining a curved ellipse or a curved oval.

7. Spray nozzle according to claim 1, wherein the mouthpiece is made from hard metal.

8. Spray nozzle according to claim 1, wherein the mouthpiece is held in a nozzle housing, and the nozzle housing, when considered in the direction of the median longitudinal axis, has an oval or elliptical passage opening surrounding the discharge opening.

9. Spray nozzle according to claim 8, wherein a circumferential wall of the nozzle housing forming the passage opening and terminating level with the discharge opening is positioned level with said discharge opening and perpendicular to the median longitudinal axis spaced from the boundary of the discharge opening, so that a spray jet emerging from the discharge opening does not contact the circumferential wall.

10. Spray nozzle according to claim 8, wherein at least one of the mouthpiece and the nozzle housing are manufactured by metal powder die casting.

11. Spray nozzle for descaling steel products, having a mouthpiece, with the mouthpiece including a discharge opening and a discharge chamber tapering towards said discharge opening, wherein the discharge opening spans a curved surface and a surface surrounding a boundary of the discharge opening contacts each point of said boundary radially at an angle of 90° to a median longitudinal axis on the boundary of the discharge opening.

12. Spray nozzle for descaling steel products, having a mouthpiece, with the mouthpiece including a discharge opening and a discharge chamber tapering towards said discharge opening, wherein the discharge opening spans a curved surface and a surface surrounding a boundary of the discharge opening contacts each point of said boundary at an angle between 65° and 95° to a median longitudinal axis on the boundary of the discharge opening, wherein the nozzle is free from water-guiding nozzle components downstream of the discharge opening.

13. Spray nozzle for descaling steel products, comprising:

a mouthpiece having an elliptical discharge opening that spans a curved surface, a discharge chamber that tapers inwardly toward the elliptical discharge opening, and an end face surrounding the elliptical discharge opening, the end face contacting each point of an entirety of a boundary about the elliptical discharge opening to define an angle between approximately 65° and 95° with respect to a median longitudinal axis of the mouthpiece, wherein the end face is defined by first and second convex sectors and third and fourth concave sectors, each said sector contacting a portion of the boundary of the elliptical discharge opening; and a nozzle housing for receiving the mouthpiece.

14. Spray nozzle according to claim 13, wherein each point of the end face about the boundary of the elliptical discharge opening, and the portion of the end face extending radially outwardly from each said point, define a line in a radial direction that is transverse with respect to the median longitudinal axis of the mouthpiece.

15. Spray nozzle according to claim 13, wherein the end face contacts each said point of the boundary about the elliptical discharge opening to define an angle between 85° and 95° with respect to the median longitudinal axis of the mouthpiece.

16. Spray nozzle for descaling steel products, comprising:

a mouthpiece having a discharge opening that spans a curved surface, a discharge chamber that tapers inwardly toward the discharge opening, and an end face surrounding the discharge opening, the end face contacting each point of an entirety of a boundary about the discharge opening to define an angle between approximately 65° and 95° with respect to a median longitudinal axis of the mouthpiece; and a nozzle housing for receiving the mouthpiece, wherein the nozzle is free from water-guiding components downstream of the discharge opening.

* * * * *